United States Patent [19]

Smith

[11] Patent Number: 4,519,169

[45] Date of Patent: May 28, 1985

[54] PORTABLE ORBITING GRINDING MACHINE

[75] Inventor: Thomas V. Smith, Troy, N.Y.

[73] Assignee: The United States of America as represented by the Secretary of the Army, Washington, D.C.

[21] Appl. No.: 550,856

[22] Filed: Nov. 14, 1983

[51] Int. Cl.[3] ..... B24B 19/26

[52] U.S. Cl. ..... 51/241 S; 51/241 B; 51/5 D; 51/120

[58] Field of Search ..... 51/241 B, 241 S, 241 A, 51/245, 241 R, 5 D, 119, 120

[56] References Cited

U.S. PATENT DOCUMENTS

| | | | |
|---|---|---|---|
| 1,819,453 | 8/1931 | Barber | 51/241 A |
| 2,297,074 | 9/1942 | Rohrdanz | 51/241 B |
| 2,614,372 | 10/1952 | Kelly | 51/241 A |
| 3,526,060 | 9/1970 | Hall et al. | 51/241 R |
| 3,587,194 | 6/1971 | Brown | 51/241 S |
| 4,109,635 | 8/1978 | Rossborough | 51/241 S |

*Primary Examiner*—Roscoe V. Parker

*Attorney, Agent, or Firm*—Anthony T. Lane; Robert P. Gibson; Michael C. Sachs

[57] ABSTRACT

A portable orbiting grinding machine to grind the gas check seat on 155 mm gun tubes. The critical sealing surface is ground concentric with the chamber diameter. Instead of moving the gun tube to a specified machine tool, the portable grinding machine can be loaded on a specified tube for grinding the gas check seat then moved to the next tube to start the sequence again. A hydraulically expanded arbor grips the gun tube chamber diameter. An orbital spur gear assembly rotates on the expanding arbor extension and has a longitudinal travel on the extension controlled by a feed mechanism assembly. A removeable grinding quill is held by the spur gear assembly as it rotates. A sleeve type grinding wheel dresser assembly has a blade that may be mechanically actuated to bear against the grinding wheel and is spring loaded away from the grinding wheel when not in use.

5 Claims, 2 Drawing Figures

Fig — 1 —

PORTABLE ORBITING GRINDING MACHINE

GOVERNMENT INTEREST

The invention described herein may be manufactured and/or used by or for the Government for governmental purposes without the payment of any royalty thereon.

BACKGROUND OF THE INVENTION

The gas check seat is a critical sealing surface on the entrance end of gun tube chambers and is ground concentric with the chamber diameter. Previous procedures require overhead crane handling of the gun tube to bring the gun tube to the grinding machine, positioning the tube so that the chamber diameter runs concentric with the axis of the machine, and upon completion of the grinding operation, removing the tube from the machine and moving it to another station.

The concept of the portable grinding machine comprising the present invention eliminates overhead crane handling and moving of gun tubes to a specified machine tool. It also eliminates the need of indicating the true center of the tube chamber, since the portable machine when positioned on the gun tube automatically picks up the true axis of the chamber. The entire grinding operation may be performed in a benching area where numerous gun tubes could be positioned on racks. The portable grinding machine would be handled by a small jib crane and loaded on a specified tube. After grinding the seat the machine could be unloaded from the tube, moved to the next tube in line and the sequence started again.

SUMMARY OF THE PRESENT INVENTION

In accordance with the present invention a portable orbiting grinding machine for grinding gas check seats on 155 mm gun tubes is provided, making it easier to move and mount the machine on the gun tube than to move and place the gun tube on a specified machine tool.

The grinding machine has a body assembly on which slings are mounted for attachment to a small crane to move it about. The body assembly has a hydraulically expanded arbor for gripping the gun tube chamber diameter. An orbital spur gear assembly rotates on the expanding arbor extension and longitudinal travel on the extension is controlled by a feed mechanism assembly. A removeable grinding quill is held by the spur gear assembly as it rotates. A sleeve type grinding wheel dresser assembly has a blade that may be mechanically actuated to bear against the grinding wheel and is spring loaded away from the grinding wheel when not is use.

DETAILED DESCRIPTION OF PREFERRED EMBODIMENT

Figure 1:
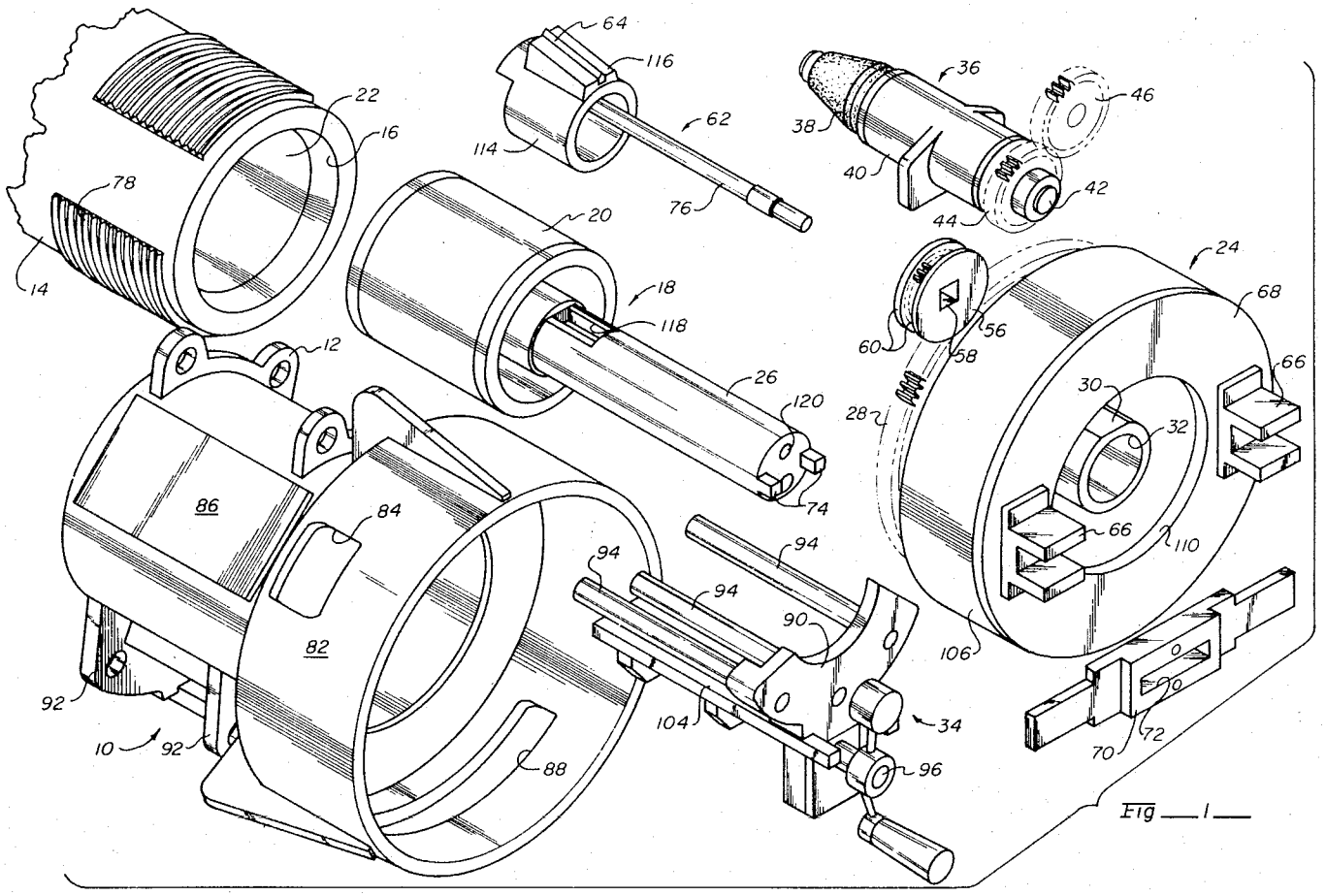
FIG. 1 is an exploded perspective view of the Orbiting Grinding Machine.

Referring now to FIG. 1 the portable grinding machine comprising the present invention includes a body assembly 10 which provides for the positioning and holding of other machine subassemblies and units. A lifting sling assembly attached to ears 12 on the body assembly 10 permits attachment to a small jib crane, now shown, for movement and positioning of the machine over the end of the gun tube 14 having a gas check seat 16 to be ground. The machine is mounted by insertion of a hydraulically expanded arbor assembly 18 into the gun tube. By mechanical activation the expansion arbor sleeve 20 may be expanded to grip the chamber 22. The expansion arbor sleeve 20 operates in a range of 6.690 diameter to 6.700 diameter.

An orbital spur gear assembly 24 rotates on the expanding arbor extension 26 and also moves longitudinally on the same extension. It consists of a spur gear 28 with a long hub 30 and bronze sleeve bearing 32. The longitudinal travel of the orbital spur gear assembly 24 is controlled by a feed mechanism assembly 34. A grinding quill 36 is mounted within the gear assembly 24. It is removably mounted to facilitate the changing of grinding wheels 38. The grinding quill 36 consists of a flanged housing 40 which holds a ballbearing spindle 42 with a grinding wheel 38 on one end. A spur driving gear 44 is mounted on the other end of the spindle 42. This driving gear, when engaged with spur gear 46 which is attached to the shaft of a spindle driving motor, not shown in FIG. 1 but shown as 48 and 50 in FIG. 2, will rotate the spindle 42 at the proper RPM for grinding.

Figure 2:
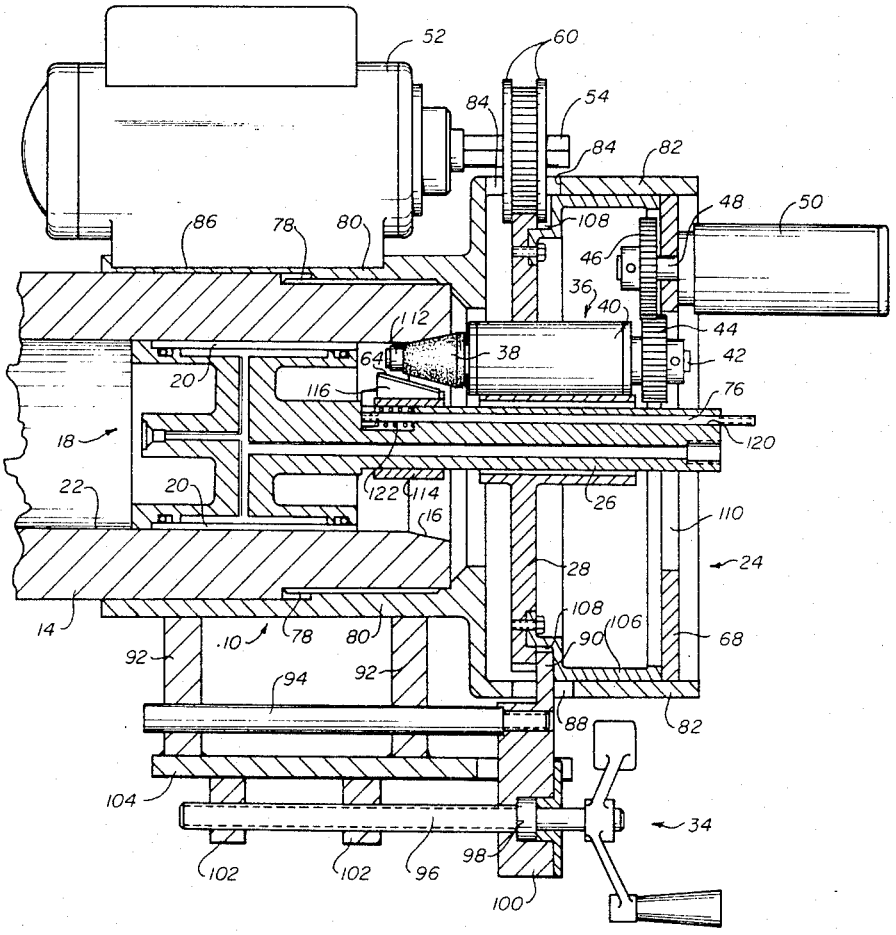
FIG. 2 is a sectional view in elevation to more clearly show the relationship of the various assemblies.

The orbiting drive motor, not shown in FIG. 1 but shown as 52 and 54 in FIG. 2, has a square output shaft to allow spur gear 56 to slide longitudinally along its axis. Spur gear 56 has a square aperture 58 to receive shaft 54. This gear has flanges 60 on each side and when engaged with the large orbiting gear 28 will slide fore and aft on the square motor shaft 54 as the feed mechanism assembly 34 moves the orbital spur gear assembly 24 along the axis of the expanded arbor extension 26.

A grinding wheel dresser assembly 62 is a sleeve type assembly free to slide on the expanding arbor extension 26. The dresser has a blade 64 that may be mechanically actuated against the grinding wheel 38 and, when not in use, is spring loaded away from the grinding wheel. Wheel dresser positioning blocks 66, mounted on the cover 68 of the orbital spur gear assembly 24 is used to hold the wheel dress positioning leaf 70. The positioning leaf 70 is used only when dressing of the grinding wheel 38 is required. When leaf 70 is placed between positioning blocks 66, leaf slot 72 engages key 74 in the end of the expanding arbor extension 26 to align the grinding wheel dresser blade 64 with the grinding wheel 38. Thus the horizontal centerline established by the positioning leaf 70, is 90 degrees to the centerline passing through the grinding quill assembly 36 and the long hub 30 of the orbital spur gear assembly 24. To redress the grinding wheel, the orbiting drive motor 52 is turned off, the grinding wheel spindle drive motor 50 is turned on, and the wheel dresser assembly 62 is pulled into the grinding wheel 38 by a hand knob, not shown, on actuator rod 76 on dresser assembly 62.

A more detailed description of the components, their assembly, their relationship and function can be made with reference to the side elevational view in FIG. 2 in conjuntion with FIG. 1. Here can be seen the body assembly 10 positioned over the breech end of gun tube 14 having a tapered gas check seat 16 to be ground by the orbiting grinding machine of this invention. Interfacing with the sectored thread form 78 of the gun tube 14 is the sectored thread form 80 of the body assembly 10. Large cylinder 82 of the body assembly has an inner diameter on the order of 17.000 inches and performs the function of a safety shield for the rotating parts of the grinding machine. The orbital spur gear assembly 24 must rotate freely within cylinder 82. Cut-out 84 in cylinder 82 allows access for clearance of the orbital drive spur gear 56 to engage the 16.00 pitch diameter spur gear 28. Motor 52 which rotates gear 56 is mounted on flat surface 86 of the assembly. A larger cut-out 88 in the bottom of cylinder 82 allows access for the feed finger 90 which is part of the feed mechanism assembly 34.

The hydraulically expandable arbor assembly 18 fits within the gun tube chamber 22 to provide concentricity to the rotation of the grinding quill assembly 36 as it orbits around the arbor extension 26. A hydraulic fluid actuated expansion sleeve 20 on assembly 18 has a 6.690 inch to 6.700 inch diameter expansion range to fit the chamber 22 of the gun tube. The assembly 18 has an appropriate fluid refill and pressurizing capability to insure sufficient expansion of sleeve 20 as desired.

The feed assembly 34 manually feeds or withdraws the formed grinding wheel 38 to or from the tapered gas check seat 16 on the gun tube 14. The assembly mounts, such as by welding, on two lugs 92 of the body assembly 10. These same lugs 92 receive three guide pins 94 of the feed assembly 34 in bushings, not shown, to permit feed finger 90 to move fore or aft in slot 88 of cylinder 82, and thus move grinding wheel 38 fore or aft against the gas check seat 16. This movement is imparted by the feed screw 96 whose shoulder 98 is free to rotate within the lower support 100 of feed finger 90. Screw 96 threads into posts 102 which extend down from assembly support 104 and rotation of the screw 96 gives it the fore and aft movement.

The orbital spur gear assembly 24 fits within cylinder 82 and is mounted on and revolves around the arbor extension 26. It includes a spur gear 28 which engages drive gear 56 which is driven by motor 52. The teeth of gear 28 fit between spaced flanges 60 of gear 56 to move it laterally on the square motor shaft 54 as the gear assembly 24 moves fore and aft on the arbor extension 26. A support sleeve 106 is attached to spur gear 28 with a space 108 provided to receive feed finger 90. It is this finger 90 that moves the gear 28 fore and aft in response to the rotation of feed screw 96 of the feed mechanism assembly 34. Cover 68 is fastened to the support sleeve 106 and rotates with it within cylinder 82. On it is mounted the spindle driving motor 50. A spur driving gear 46 on motor shaft 48 drives gear 44 on spindle 42 to which grinding wheel 38 is connected. Cover 68 has a sufficiently large opening 110 to permit removal of the removeable grinding quill 36. The function of the orbital spur gear assembly 24 is to provide exact positioning of the grinding quill assembly 36 relative to the center line of the expanded arbor assembly 18 and allow for the orbital rotation of the grinding quill assembly 36 about this same center line.

The grinding quill assembly 36 is removeable as a unit to provide for changing or replacing the grinding wheel 38 when it is worn down. It is held on the spur gear 28 by screws, not shown, and the assembly 36 is a slip fit in the aperture in the gear 28. To replace grinding wheel 38, it is only necessary to back off and remove the retainer nut 112, allowing the grinding wheel 38 to slip off the spindle 42 and be replaced with a new wheel.

The wheel dresser assembly 62 consists of a dresser body 114, keyguide 116, actuator rod 76, and dresser blade 64. Since the dresser blade 64 is used to dress the finish form on the grinding wheel 38, it has the same taper as the taper on the gas check seat 16 of the gun tube chamber 22. To assemble, the dresser body 114 is slipped over the arbor extension 26. It has a sliding fit. The keyguide 116 is then attached to the dresser body 114, fitting the key section of the guide in the keyway 118 that is machined in the arbor extension 26. The actuator rod 77 is then slipped through the long hole 120 in the arbor extension 26, then through a short compression spring 122, and then threaded into a threaded hole 124 in the keyguide 116. This assembly is now complete. It should be noted that the compression spring 122 forces the dresser body 114 and dresser blade 64 away from the grinding wheel 28. To come in contact with the grinding wheel 38 and dress a new form on the wheel, it is necessary to pull the wheel dresser assembly 62 into the grinding wheel 38 by pulling on actuator rod 76. If desired, a threaded knob, not shown, can be placed on the end. By tightening the knob or pulling on it, the spring 122 will compress and the dressing blade 64 will engage the grinding wheel 38 to dress the form. Upon release, the spring will move the blade away from the grinding wheel and allow the freshly dressed grinding wheel to be fed into the gas check seat of the gun tube to perform its grinding operation.

It should be obvious that the orbital drive motor must be turned off after alignment of the grinding wheel dresser assembly is achieved and that the spindle drive motor should be started before any movement of the wheel dresser assembly is made toward the grinding wheel.

The invention in its broader aspects is not limited to the specific combinations, improvements and instrumentalities described but departures may be made therefrom within the scope of the accompanying claims without departing from the principles of the invention and without sacrificing its chief advantages.

What is claimed is:

1. A portable orbiting grinding machine for grinding the gas check seat on a gun tube, said machine comprising:

an expandable arbor adapted to fit within said gun tube, an orbital spur gear assembly mounted on said arbor extension and adapted to revolve thereon, said spur gear assembly including a grinding wheel having a shape desired for said gas check seat, and a feed mechanism assembly for providing logitudinal travel of said spur gear assembly on said arbor extension to engage and disengage said grinding wheel with said gas check seat, and means for revolving said grinding wheel and said orbital spur gear assembly.

2. A portable orbiting grinding machine as set forth in claim 1 wherein a grinding wheel dresser assembly is mounted in said arbor extension, said dresser assembly having a blade of desired shape adapted to bear against said grinding wheel to give it a desired grinding shape as said grinding wheel revolves while in contact with said blade.

3. A portable orbiting grinding machine as set forth in claim 2 wherein said blade is spring loaded to move out of contact with said grinding wheel when not in use.

4. A portable orbiting grinding machine as set forth in claim 1 wherein said machine includes a body assembly which mounts over the end of said gun tube and said means for revolving said orbital spur gear assembly is a motor mounted on said body assembly.

5. A portable orbiting grinding machine as set forth in claim 1 wherein said orbital spur gear assembly includes a spur gear on said arbor extension, a cover spaced therefrom and attached for rotation therewith, a grinding quill mounted on said spur gear, said grinding quill including said grinding wheel, said means for revolving said grinding wheel including a motor mounted on said cover.

* * * * *